US009816793B2

(12) United States Patent
Budy et al.

(10) Patent No.: US 9,816,793 B2
(45) Date of Patent: Nov. 14, 2017

(54) SHOCK-RESISTANT FUZEWELL FOR MUNITION

(71) Applicant: Raytheon Company, Waltham, MA (US)

(72) Inventors: George D. Budy, Tucson, AZ (US); Wayne Y. Lee, Santaquin, UT (US); Jesse T. Waddell, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 0 days.

(21) Appl. No.: 15/117,875

(22) PCT Filed: Feb. 11, 2015

(86) PCT No.: PCT/US2015/015414

§ 371 (c)(1),
(2) Date: Aug. 10, 2016

(87) PCT Pub. No.: WO2015/175036

PCT Pub. Date: Nov. 19, 2015

(65) Prior Publication Data

US 2017/0167839 A1 Jun. 15, 2017

Related U.S. Application Data

(60) Provisional application No. 61/986,985, filed on May 1, 2014, provisional application No. 61/938,297, filed on Feb. 11, 2014.

(51) Int. Cl.
*F42C 19/02* (2006.01)
*F42B 12/24* (2006.01)
(Continued)

(52) U.S. Cl.
CPC ..... *F42C 19/02* (2013.01); *F42B 12/04* (2013.01); *F42B 12/204* (2013.01); *F42B 12/24* (2013.01); *F42B 25/00* (2013.01)

(58) Field of Classification Search
CPC .... F42B 12/207; F42B 12/204; F42B 12/208; F42C 11/00
(Continued)

(56) References Cited

U.S. PATENT DOCUMENTS 2,183,502 A * 12/1939 Lefere ..... B21K 21/04 102/493
2,411,862 A * 12/1946 Arnold ..... B22C 9/00 102/493
(Continued)

FOREIGN PATENT DOCUMENTS

CH 649627 A5 5/1985
DE 2557676 A1 6/1977
(Continued)

OTHER PUBLICATIONS

International Search Report for corresponding International Application No. PCT/US2015/015414 dated Nov. 24, 2015.
(Continued)

*Primary Examiner* — John D Cooper
(74) *Attorney, Agent, or Firm* — Renner, Otto, Boisselle & Sklar, LLP

(57) ABSTRACT

A munition, such as a warhead, includes a penetrator casing for penetrating hard targets, such as a fortification or inforced building or other structure, with the penetrator casing having reduced-thickness portions. The munition also includes a shock-resistant fuzewell for absorbing shocks during the penetration, to allow a fuze within the fuzewell to survive hard target penetration. The fuzewell may have one or more shock-absorbing features, such as having a ring surrounding a central housing, with flexible spokes connecting the ring to the central housing. The shock-absorbing features may allow the fuze to withstand the penetration into
(Continued)

a hard target, with the fuze subsequently being used to detonate an explosive of the munition.

19 Claims, 5 Drawing Sheets

(51) Int. Cl.
*F42B 12/04* (2006.01)
*F42B 12/20* (2006.01)
*F42B 25/00* (2006.01)

(58) Field of Classification Search
USPC ..... 102/479, 389, 489, 491–497
See application file for complete search history.

(56) References Cited

U.S. PATENT DOCUMENTS 3,134,330 A * 5/1964 Batou ..... B01D 3/30 102/376
3,744,419 A * 7/1973 Hand ..... F42B 4/26 102/360
3,820,464 A * 6/1974 Dixon ..... F42B 12/22 102/493
3,981,243 A 9/1976 Doris, Jr.
4,592,283 A 6/1986 Hellner et al.
4,648,323 A 3/1987 Lawther
4,664,035 A 5/1987 Osofsky
4,693,317 A * 9/1987 Edwards ..... E21B 17/07 166/378
5,117,759 A 6/1992 Henderson et al.
5,131,329 A 7/1992 Lips et al.
5,305,505 A 4/1994 Ruhlman
5,535,679 A 7/1996 Craddock
5,698,814 A * 12/1997 Parsons ..... B26F 3/04 102/307
5,717,397 A 2/1998 Ruszkowski, Jr.
5,939,662 A 8/1999 Bootes et al.
6,105,505 A 8/2000 Jones
6,135,028 A 10/2000 Kuhns et al.
6,186,072 B1 2/2001 Hickerson, Jr. et al.
6,374,744 B1 4/2002 Schmacker et al.
6,484,642 B1 * 11/2002 Kuhns ..... F42B 12/24 102/493
6,601,517 B1 8/2003 Guirguis
6,619,210 B1 9/2003 Spivak et al.
6,659,013 B1 12/2003 Kellner
7,231,876 B2 * 6/2007 Kellner ..... F42B 12/204 102/491
7,614,348 B2 11/2009 Truitt et al.
7,971,533 B1 * 7/2011 Berlin ..... F42C 19/02 102/206
8,061,275 B1 11/2011 Gold
8,161,884 B1 * 4/2012 Kokodis ..... F42B 12/24 102/476
8,176,849 B1 5/2012 Gold et al.
8,191,479 B2 6/2012 Ruhlman et al.
8,234,979 B1 8/2012 Falabella et al.
8,387,539 B1 * 3/2013 Maines ..... F42B 12/24 102/491
8,671,840 B2 3/2014 Scheid et al.
8,701,557 B2 4/2014 Biggs et al.
9,423,226 B2 * 8/2016 Cillaut
2003/0167956 A1 * 9/2003 Kellner ..... F42B 12/204 102/517
2005/0115450 A1 6/2005 Lloyd
2005/0223930 A1 10/2005 Bootes et al.
2005/0235862 A1 * 10/2005 Gousman ..... F42B 12/22 102/493
2010/0032515 A1 2/2010 Geswender et al.
2011/0162548 A1 * 7/2011 Berlin ..... F42C 19/02 102/275.9
2012/0017795 A1 1/2012 Dryer et al.
2012/0227609 A1 9/2012 Volkmann
2012/0291651 A1 11/2012 Haumann et al.

FOREIGN PATENT DOCUMENTS

EP 1001244 A1 5/2000
EP 1316774 A1 6/2003
EP 1367358 A2 12/2003
EP 1864960 A2 4/2007
EP 2095059 B1 6/2010
FR 2910612 A1 6/2008
GB 2384291 A 11/1993
WO 98/30863 A1 7/1998
WO 9830863 A1 7/1998
WO 0203008 A1 1/2002
WO 2008089078 A2 7/2008
WO 2008096069 A1 8/2008
WO 2009102254 A1 8/2009
WO 2011054361 A1 5/2011
WO 2011054361 A1 12/2011
WO 2015175036 A2 11/2015
WO 2015175037 A2 11/2015
WO 2015175038 A2 11/2015
WO 2015175039 A2 11/2015
WO 2015175040 A2 11/2015
WO 2016022181 A1 2/2016
WO 2016022199 A1 2/2016

OTHER PUBLICATIONS

Written Opinion for corresponding International Application No. PCT/US2015/015414 dated Nov. 24, 2015.

* cited by examiner

SHOCK-RESISTANT FUZEWELL FOR MUNITION

This application claims priority to U.S. Provisional Application 61/938,297, filed Feb. 11, 2014, and to U.S. Provisional Application 61/986,985, filed May 1, 2014. Both of these applications are incorporated by reference in their entireties.

FIELD OF THE INVENTION

The present invention generally relates to munitions, and fuzewells for containing fuzes for munitions.

DESCRIPTION OF THE RELATED ART

Weapons (munitions) for penetrating hard targets, such as buildings or fortifications having reinforced concrete walls, have generally used steel casings to survive challenging impact conditions against hardened target structures. Using solid steel cased cylindrical wall structures that protect the explosive payload during penetration have been the standard. During such a penetration a significant shock is transmitted throughout the munition.

SUMMARY OF THE INVENTION

A warhead for a munition, such as a missile or bomb, has a penetration casing for penetrating hard targets, and a shock-resistant fuzewell for absorbing shocks during the penetration, to allow a fuze within the fuzewell to survive hard target penetration. The fuzewell may have one or more shock-absorbing features, such as having a ring surrounding a central housing, with flexible spokes connecting the ring to the central housing. The shock-absorbing features may allow the fuze to withstand the penetration into a hard target, with the fuze subsequently being used to detonate an explosive of the munition. The casing may be configured so as to enhanced formation of fragments from the casing when the explosive enclosed by the casing is detonated. The casing may also include lethality-enhancement material, for example including preformed fragments or an energetic material, that may be placed at reduced-thickness portions of the casing.

According to an aspect of the invention, a munition includes: a penetrator casing; and a fuzewell within the penetrator casing; wherein the fuzewell includes one or more shock-absorbing features for absorbing shocks.

According to another aspect of the invention, a munition includes: a penetrator casing; and a fuzewell within the penetrator casing; wherein the fuzewell includes one or more deformable structures that preferentially deform relative to a central housing of the fuzewell.

In some embodiments the one or more shock-absorbing features facilitate absorption of shocks in a radial, circumferential, and/or axial direction.

In some embodiments the fuzewell includes a central housing, and a ring surrounding the central housing.

In some embodiments the one or more shock-absorbing features include spokes that connect the ring to the central housing.

In some embodiments the spokes have curvature and/or variations in thickness that facilitate flexing of the spokes in response to forces on the munition, such as forces in the radial, circumferential, and/or axial direction.

In some embodiments the spokes have curvature in a circumferential direction.

In some embodiments the spokes define openings between the spokes, with the openings operable to vent gases from an explosive that is within the casing.

In some embodiments the central housing has a non-uniform thickness.

In some embodiments the ring is connected to a relatively thick portion of the central housing.

In some embodiments the munition includes a fuze within the central housing, the fuze operably coupled to an explosive within the penetrator casing to detonate the explosive.

In some embodiments the central housing has an opening for receiving an electrical line for coupling to the fuze.

In some embodiments the fuzewell has an axisymmetric configuration.

According to yet another aspect of the invention, a munition includes: a penetrator casing; an explosive within the casing; and a fuzewell within the penetrator casing; wherein the fuzewell includes one or more openings that allow venting from the explosive.

In some embodiments the fuzewell includes a central housing, and a ring around the central housing; and the openings are between the central housing and the ring.

In some embodiments the fuzewell includes spokes connecting the ring to the central housing; and the spokes define the openings therebetween.

To the accomplishment of the foregoing and related ends, the invention comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

BRIEF DESCRIPTION OF DRAWINGS

The annexed drawings, which are not necessarily to scale, show various aspects of the invention.

DETAILED DESCRIPTION

A munition, such as a warhead, includes a penetrator casing for penetrating hard targets, such as a fortification or reinforced building or other structure, with the penetrator casing having reduced-thickness portions. The munition also includes a shock-resistant fuzewell for absorbing shocks during the penetration, to allow a fuze within the fuzewell to survive hard target penetration. The fuzewell may have one or more shock-absorbing features, such as having a ring surrounding a central housing, with flexible spokes connecting the ring to the central housing. The shock-absorbing features may allow the fuze to withstand the penetration into a hard target, with the fuze subsequently being used to detonate an explosive of the munition.

In the following description, a general description of a penetrator munition is given first, with the munition including a shock-absorbing fuzewell. Details of the fuzewell are then discussed. In much of the following description the munition is described as a penetrator munition that is capable of penetrating hard targets. However, the shock-absorbing fuzewell is capable of being used in a variety of different types of munitions, not just in the penetrator munition that is shown in the figures.

Figure 1:
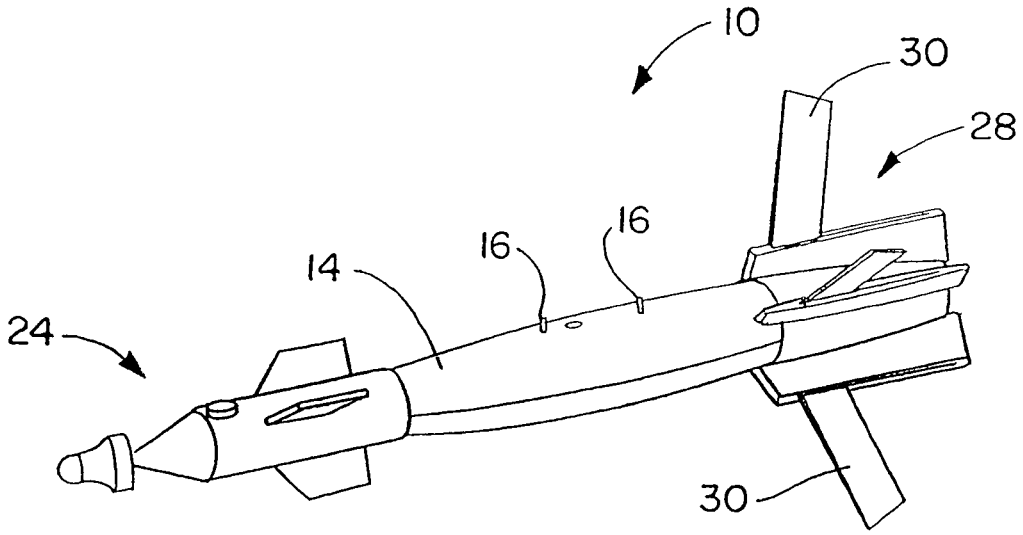
FIG. 1 is an oblique view of a munition in accordance with the present invention.
Figure 2:
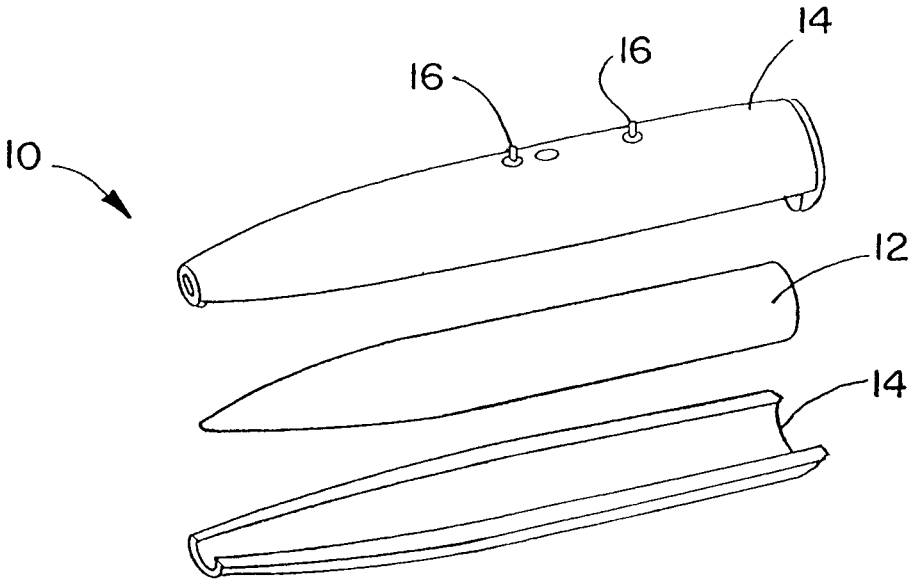
FIG. 2 is an exploded view showing parts of the munition of FIG. 1.
Figure 3:
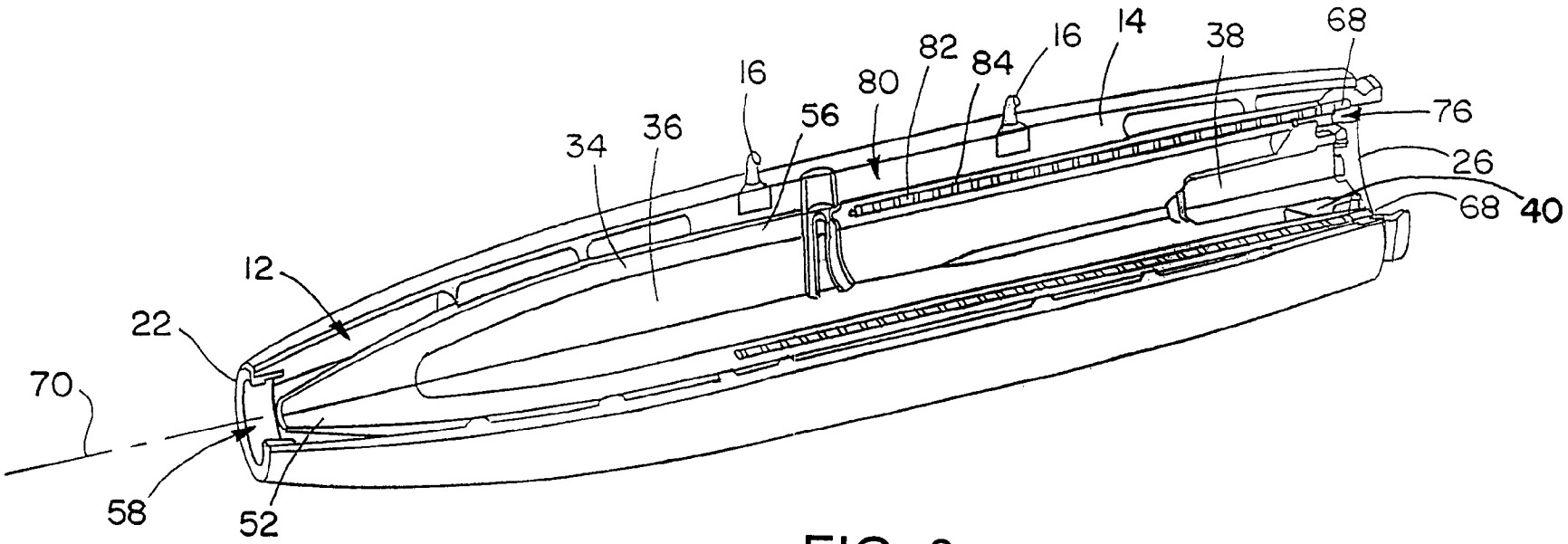
FIG. 3 is an oblique partial cutaway view showing details of a warhead of the munition of FIG. 1.

Referring initially to FIGS. 1-3, a munition 10, such as a missile or guided bomb, has a warhead 12 that is contained within an airframe 14 that has connection lugs 16 for connection to an aircraft or other platform for launching the munition 10. The airframe 14 has a forward connection 22 for receiving a guidance nose kit 24 (for example), and an aft connection 26 for receiving (for example), a tail kit 28 with deployable fins 30. The airframe 14 may be configured for using a standard weapons mount on a launch platform that is also able to receive other types of weapons. The connections 22 and 26 may be standard connections that are similar to those used for other munitions, thus enabling use of standard nose and tail kits that may be used with other sorts of munitions. The airframe 14 may be in the form of a pair of clamshell halves that fit around the warhead 12, and may be made of a relatively lightweight material, such as aluminum.

The warhead 12 has a penetrator casing 34 that encloses an explosive 36. There may be an asphaltic liner (not shown) between a penetrator casing 34 and an explosive 36. The asphaltic liner serves as a sealing material and protective layer for the explosive 36 during storage, transportation and target penetration.

The explosive 36 is detonated by a fuze 38 that is at an aft end of the explosive 36, housed in a fuzewell 40. The casing 34 has a forward nose 52, and an aft section 56 extending back from the nose 52. In the illustrated embodiment, the forward nose 52 of the penetrator case 34 is solid in nature, a monolithic structure with no cutout or through holes to accommodate forward mounted fuzing such as that used in general purpose bomb cases. The forward nose 52 is thickest at an apex 58 of the nose 52, and has a thickness that reduces the farther back you go along the casing 34, tapering gradually to the thickness of the substantially cylindrical aft section 56. The nose 52 may have a maximum thickness that is at least twice the thickness of the thickest part of the casing 34 in the cylindrical aft section 56.

The fuze 38 may be operably coupled to the nose kit 24, for example to receive from the nose kit 24 a signal to detonate the fuze 38. The nose kit 24 may include a sensor or other device that it is used to provide a signal to trigger the firing of the fuze 38. The triggering event may be the munition 10 reaching a desired height for detonation (height of burst), for example.

The connection between the nose kit 24 and the fuze 38 may include an external electrical harness and an internal electrical line or cord (or cable) that runs through a conduit that is inside the explosive 36. The harness may run outside of the casing 34, between the casing 34 and the airframe 14. A forward end of the harness is coupled to the nose kit 24 at the forward connection 22, near the nose 52. An aft end of the harness may be connected to a coupling that is in the middle of the casing 34. From the coupling the signal travels back to the fuze 38 through the electrical line or cable. An umbilical cable (not shown) may also be connected to the fuze 38, to provide data, instructions, or other information to the munition 10 prior to launch.

Figure 5:
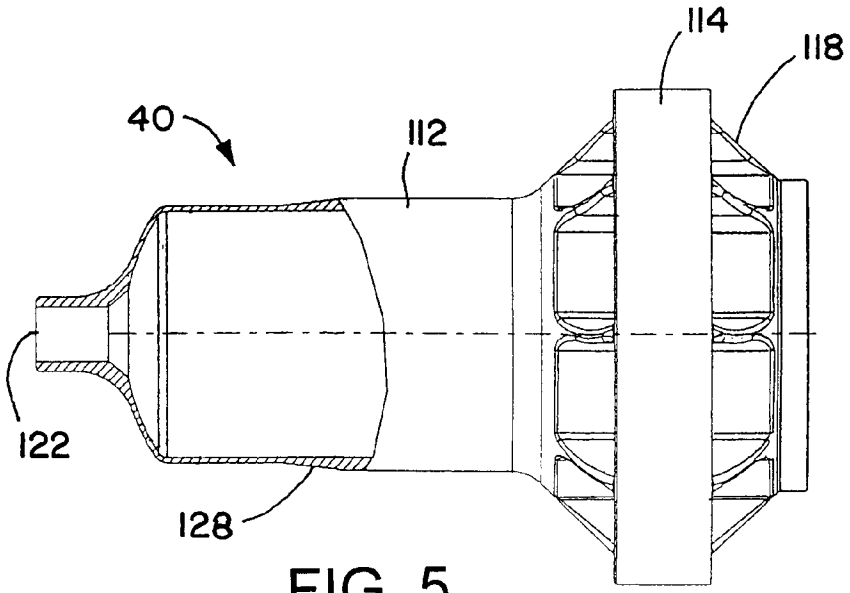
FIG. 5 is a side partial sectional view of the fuzewell of FIG. 4.
Figure 4:
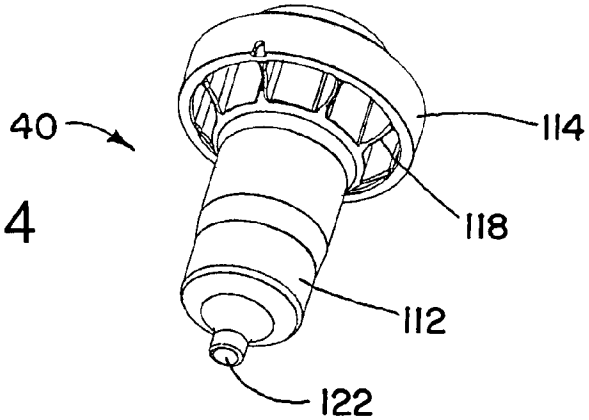
FIG. 4 is an oblique view of a fuzewell of the munition of FIG. 1.
Figure 6:
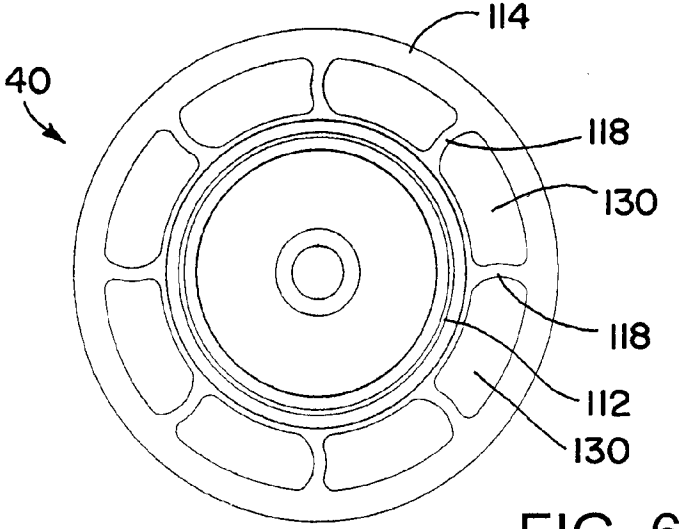
FIG. 6 is an end view of the fuzewell of FIG. 4.

With reference now in addition to FIGS. 4-6, the fuzewell 40 provides protection for the fuze 38 against shocks propagating through the warhead 12, for example as when the munition 10 impacts a hard target. It is desirable that the fuze 38 remain operable after such an impact, in order to allow detonation of the explosive 36 only after perforation of the hard target has been accomplished. Toward that end the fuzewell 40 has a configuration that allows it to resiliently absorb some energy, softening the effect of impacts such as during penetration of a hard target. The fuzewell 40 has a central housing 112 that contains the fuze 38, and a ring 114 around the central housing 112 that is connected to the housing 112 by a series of spokes 118. An opening 122 in the housing 112 enables connection of the electrical line to the fuse 38.

The spokes 118 are curved in the circumferential direction, longitudinal direction or a combination of the two directions thereof, with appropriate thicknesses. This facilitates flexing of the spokes in response to forces on the fuzewell 40 in a radial direction. The spokes 118 also may be configured to facilitate flexing in response to forces in an axial direction, for example by curvature and/or by variations in thickness. The reduction in cross-sectional area of the spokes 118, relative to that of the outer ring 114 and the central housing 112, facilitates flexing of the fuzewell 40 at the location of the spokes 118. Forces in an axial direction may occur due to a direct collision of the munition 10 with a hard structure, wherein the penetrator 12 impacts substantially perpendicular to the structure. Forces in a radial direction or a circumferential direction may occur due to a non-perpendicular impact, for example.

In addition, the spokes 118 have sloped surfaces in both axial directions, with the spokes 118 sloping from a narrow connection to the ring 114 to a broader connection to the housing 112. The spokes 118 may be connected to a thicker portion 128 of the housing 112, which may also have surfaces that are sloped in the axial direction.

The fuzewell 40 defines spaces 130 between the spokes 118. The spaces 130 allow for venting of gases from the explosive 36 (FIG. 3). This may enhance the safety of the munition 10, for instance by preventing a buildup of gas pressure within the warhead 12. Venting from the spaces 130 may improve performance of the munition 10 (or a part of the munition 10) in cook-off testing, for example. The fuzewell spaces 130 also facilitate high explosive (HE) loading/casting process by allowing uncured HE slurry to be poured into the HE cavity through spaces 130. Since the fuzewell is pre-installed into the aft end of the HE cavity, this also reduces or eliminates safety concerns associated with post-cast installation of metal fuze well against metal casing.

The fuzewell 40 may be made of steel or another suitable material. The fuzewell 40 may be made as a single piece of material or a combination of sub-components that are joined together via welding or other methodologies.

Figure 7:
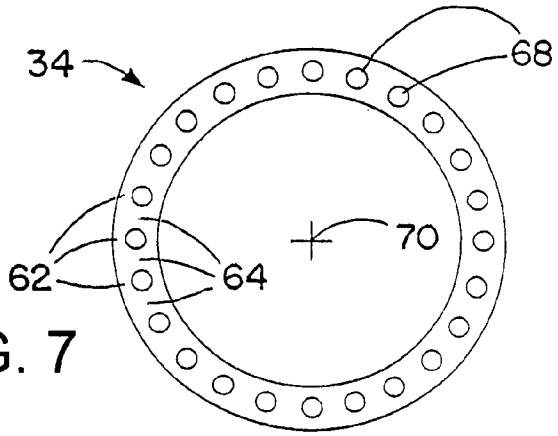
FIG. 7 is an end view showing details of a casing of the warhead of FIGS. 2 and 3.

As shown in FIG. 7, the aft section 56 has a series of reduced-thickness portions 62 that are adjacent to other portions 64 of the aft section 56 that do not have a reduced thickness. The reduced-thickness portions 62 introduce weakness into parts of the penetrator casing 34, facilitating break-up of the casing 34 when the explosive 36 is detonated. This may enhance the production of fragments from all or part of the casing 34 when the explosive 36 is detonated, enhancing the lethality of the warhead 12.

In the illustrated embodiment the reduced-thickness portions 62 are a series of holes 68 that are parallel to a longitudinal axis 70 of the warhead 12. The holes 68 do not intersect with one another, and are distributed circumferentially about the aft section 56. The holes 68 may be substantially evenly distributed in the circumferential direction around the aft section 56, although a non-even distribution is a possible alternative. The use of the holes 68 to produce the reduced-thickness portions 62 is just one possible configuration. Alternatives, such as notches or grooves on the inner and/or outer surfaces of the aft section 56, may also be used. These alternatives are discussed further below.

The reduced-thickness portions 62 in the illustrated embodiment are non-intersecting, and are elongate, having lengths (in the axial or longitudinal direction) that are for example of at least ten times their widths (in the circumferential direction). The reduced-thickness portions 62 may be substantially identical in their lengths, widths, and reduction in thickness of material, although alternatively the reduced-thickness portions 62 may vary from one to another with regard to one or more of these parameters.

The holes 68 may be filled with a lethality-enhancement material 76, to further increase the effectiveness of the warhead 12. In the illustrated embodiment, the holes 68 are filled with preformed fragments 80. The fragments 80 include two types of fragments, with steel preformed fragments 82 alternating with zirconium-tungsten preformed fragments 84, and with the fragments 82 having a different size and shape from the fragments 84. More broadly, the fragments 80 may include fragments with different materials, different shapes, and/or different sizes, although as an alternative all of the fragments may be substantially identical in material, size, and shape. Possible shapes for the fragments include spherical, star-shaped (a flat body with a series of flutes that constitute edged protrusions), cylindrical, cubic, etc. Other materials, such as spacers, may be placed between the hard preformed fragments. The material for the fragments 80 may be one or more of steel, tungsten, aluminum, tantalum, lead, titanium, zirconium, copper, molybdenum, etc. There may be any of a variety of suitable repeating patterns of different types of fragments and/or other materials in the holes 68.

The fragments 80 are projected outward from the warhead 12 when the explosive 36 is detonated. Thus the warhead 12 has the characteristics of both a penetrator weapon and a fragmentation weapon. The penetrator casing 34 remains intact as the warhead 12 strikes a hard target, such as a concrete building, allowing the warhead to penetrate into the hard target, perhaps to an interior space that may be occupied by targeted personnel. Then the fuze 38 detonates the explosive 36. This causes the casing 34, because of the weakness introduced by the reduced-thickness portions 62, to break up into fragments that can do damage within the hard target. In addition the preformed fragments 80 may enhance the fragmentation effect of the warhead 12.

The lethality-enhancement material 76 may alternatively or in addition include energetic materials, such as chemically-reactive materials. For example, the fragments 80 may be spaced apart, with energetic material placed between adjacent of the fragments within the holes 68. The energetic material may be or may include any of a variety of suitable explosives and/or incendiaries, for example hydrocarbon fuels, solid propellants, incendiary propellants, pyroforic metals (such as zirconium, aluminum, or titanium), explosives, oxidizers, or combinations thereof. Detonation of the explosive 36 may be used to trigger reaction (such as detonation) in the energetic material that is located at the reduced-thickness portions 62. This adds further energy to the detonation, and may aid in propelling the fragments 80 and/or in breaking up the penetrator casing 34 into fragments.

Many alternatives are possible for the arrangement and type of materials. The energetic materials may be placed between every adjacent pair of the fragments 80, or next to every second fragment, or every third fragment, etc. In addition, the materials may include substances that could neutralize or destroy chemical or biological agents.

In addition, fragments may be provided in openings in the airframe 14. These fragments may be in enclosed packages containing fragments and possibly other lethality enhancement materials, such as explosives. As an alternative to (or in addition to) the fragmentation packs, fragments may be otherwise placed in the openings or pockets in the airframe 14, in order to increase lethality. Fragments that are not prepackaged may be placed in the openings, for example with a potting material or covers to keep the fragments within the openings.

The lethality-enhancement material 76 may be omitted from the holes 68, if desired, with holes 68 just filled with air (for example) or gases, or liquids. Without the lethality-enhancement material 76, the enhanced fragmentation of the warhead 12 comes from the breakup of the penetrator casing 34 into smaller fragments due to the reduced thickness areas of the penetrator casing 34.

The penetrator casing 34 may be made out of a suitable metal, such as a suitable steel (for example 4340 steel) or another hard material, such as titanium. Aluminum and composite materials are other possible alternatives. An example of a suitable material for the explosive 36 is PBXN-109, a polymer bonded explosive.

Figure 8:
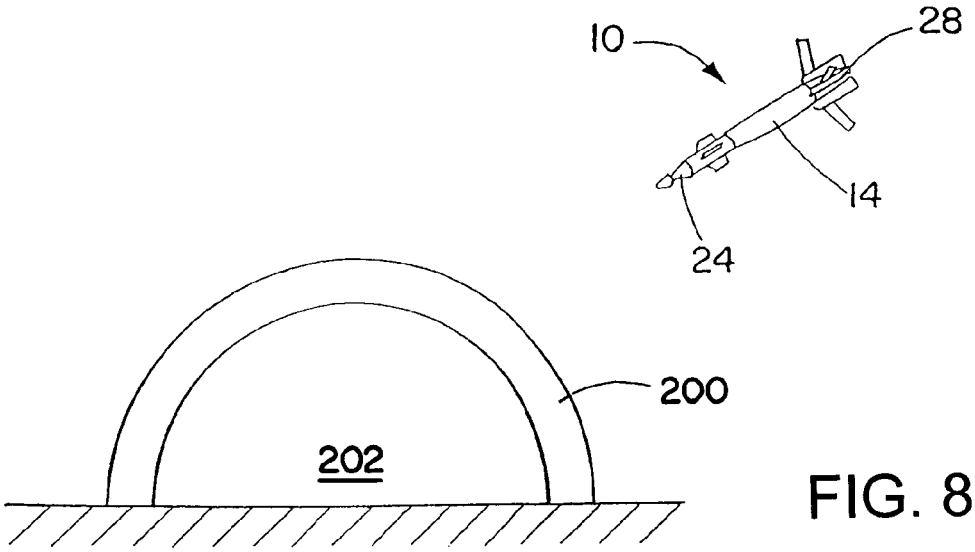
FIG. 8 is a side view illustrating a first step in the use of the munition of FIG. 1 as a hard target penetrator.
Figure 9:
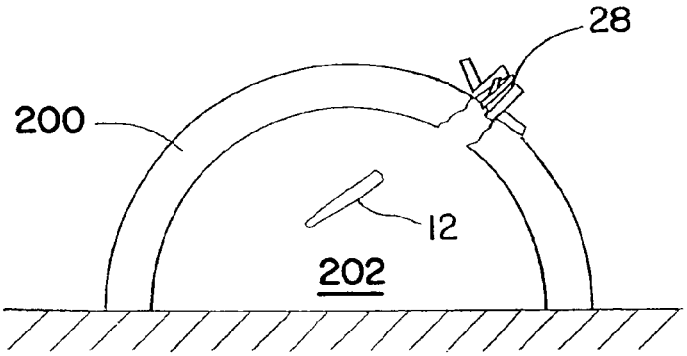
FIG. 9 is a side view illustrating a second step in the use of the munition as a hard target penetrator.
Figure 10:
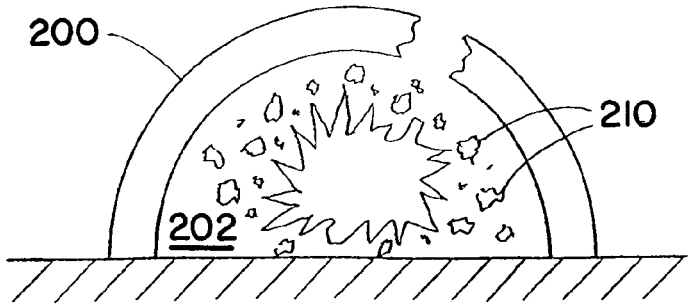
FIG. 10 is a side view illustrating a third step in the use of the munition as a harden target penetrator.

FIGS. 8-10 illustrate use of the munition 10 in a target penetration mode. In FIG. 8 the munition 10 is shown approaching a hard target 200. FIG. 9 shows the munition 10 impacting the hard target 200. Only the warhead 12, with its penetrator casing 34, is able to penetrate the hard target 200 to reach an inner area 202 of the hard target 200. The other parts of the munition, such as the airframe 14, the nose kit 24, and the tail kit 28, are destroyed and/or are separated from the warhead 12 by the collision with the hard target 200.

FIG. 10 illustrates the fragmentation effect of the warhead 12 after penetration. The illustration shows the situation after the explosive 36 has been detonated. Fragments 210 are spread within the hard target inner area 202 by the explosion. The fragments 210 include fragments produced by the destruction of the penetration casing 34, and perhaps other preformed fragments that were located in the holes 68 within the casing 34.

Figure 11:
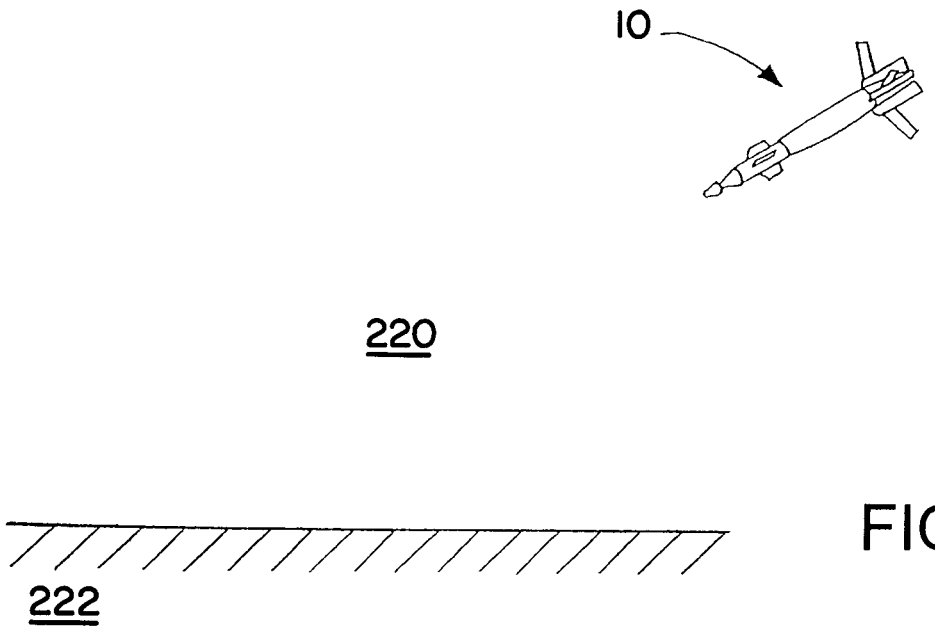
FIG. 11 is a side view illustrating a first step in the use of the munition of FIG. 1 in a fragmentation mode.
Figure 12:
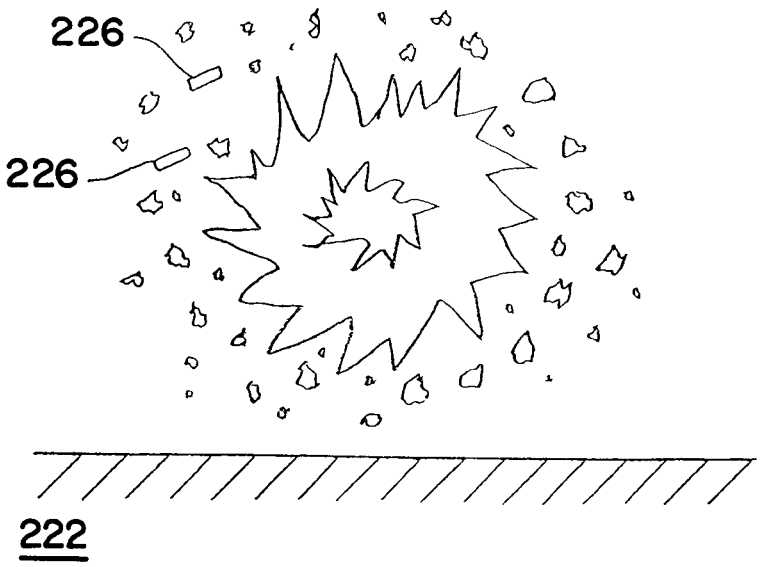
FIG. 12 is a side view illustrating a second step in the use of the munition in a fragmentation mode.

FIGS. 11 and 12 illustrate the use of the munition 10 as a fragmentation weapon, without penetration. FIG. 11 shows the munition 10 in a steep dive, approaching a desired detonation location 220 above the ground 222. The fuze 38 (FIG. 3) may be set to provide detonation at a desired height, and different heights may be used for different types of engagement (different types of soft targets, and spreads over different areas). As an example, the desired detonation location 220 may be 3-4 meters above the ground 222, although a wide variety of other detonation heights are possible.

FIG. 12 illustrates the detonation at the location 220. The detonation spreads fragments 126 about the area near the detonation location 220. As with the detonation illustrated in FIG. 10, the fragments 226 may include both pieces of the penetrator casing 34 (FIG. 3), and the preformed fragments 80 (FIG. 3). The fragmentation mode shown in FIGS. 11 and 12 may be useful for attacking soft targets that spread out to some degree, such as enemy personnel out in the open. The use of the reduced-thickness portions 62 (FIG. 7) and the inclusion of the fragments 80 (FIG. 3) in warhead 12 has been found to account for over 70% of the fragments that are sent forth by the munition 10.

The enhanced fragmentation provided by the munition 10 may allow more effective engagement of both soft and hard targets, as well flexibility in using a single munition in multiple modes, by use of the fuze 38 to control whether detonation occurs at a height above ground, or only after penetration of a hard target. The target selection (the mode of hard versus soft, the fuze delay, and/or the height of bust control setting) may be controlled in any of multiple ways: 1) preset by the ground crew before weapon launch for some systems; 2) controlled from the aircraft or other launcher before weapon launch by the pilot or ground control for some systems; and/or 3) controlled after weapon launch via a data link. The use of the reduced-thickness portions 62 (FIG. 7) and the inclusion of the fragments 80 (FIG. 3) has been found to account for over 70% of the fragments that are sent forth by the munition 10.

Many alternatives are possible for the nonuniformities in the casing, resulting in reduced-thickness portions. For example, the casing may have reduced-thickness portions in both its nose and its aft section. As another alternative, the casing may have a series of parallel grooves, in an axial direction, on an inner surface of the aft section. The grooves may have, for example, a depth of 5 percent to 80 percent of the thickness of the adjacent parts of the aft section. As yet another alternative, the casing may have axial-direction grooves that are on an outer surface of an aft section. Inner-surface grooves and outer-surface grooves may be combined in a single embodiment, and may be combinable with holes in the casing, such as the holes 68 (FIG. 7) of the warhead 12 (FIG. 1). Other arrangements are possible for non-intersecting grooves and/or holes. For example, a single spiral groove may be placed on an outer or inner surface of a casing.

Although the invention has been shown and described with respect to a certain preferred embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. A munition comprising:

a penetrator casing; and a fuzewell within the penetrator casing;

wherein the fuzewell includes one or more shock-absorbing features for absorbing shocks;

wherein the fuzewell includes a central housing, and a ring surrounding the central housing;

wherein the one or more shock-absorbing features include spokes that connect the ring to the central housing;

wherein the spokes preferentially deform relative to the central housing; and wherein the spokes are curved in a circumferential direction, with both radial surfaces of each of the spokes curved in the same circumferential direction, thereby facilitating flexing of the spokes in response to forces on the fuzewell in a radial direction.

2. The munition of claim 1, wherein the one or more shock-absorbing features facilitate absorption of shocks in a radial, circumferential, and/or axial direction.

3. The munition of claim 1, wherein the spokes have variations in thickness that facilitate flexing of the spokes in response to forces on the munition, such as forces in the radial, circumferential, and/or axial direction(s).

4. The munition of claim 3, wherein the spokes define openings between the spokes, with the openings operable to vent gases from an explosive that is within the casing.

5. The munition claim 4, wherein the central housing has a non-uniform thickness.

6. The munition of claim 5, wherein the ring is connected to a relatively thick portion of the central housing.

7. The munition of claim 1, further comprising a fuze within the central housing, the fuze operably coupled to an explosive within the penetrator casing to detonate the explosive.

8. The munition of claim 7, wherein the central housing has an opening for receiving an electrical line for coupling to the fuze.

9. The munition of claim 1, wherein the fuzewell has an axisymmetric configuration about a longitudinal axis of the munition.

10. The munition of claim 1, wherein the casing has a series of elongate reduced-thickness portions, thinner than portions of the casing that are adjacent the reduced-thickness portions.

11. The munition of claim 10, wherein the elongate reduced-thickness portions are non-intersecting elongate reduced-thickness portions.

12. The munition of claim 10, wherein the penetrator casing has a nose, and an aft section extending back from the nose;

wherein the reduced-thickness portions are parts of the aft section; and wherein the nose has a thickest portion that is at least twice the thickness of the portions of the casing that are adjacent the reduced-thickness portions.

13. The munition of claim 12, wherein the aft section is substantially cylindrical.

14. The munition of claim 10, further comprising a lethality-enhancement material located at the reduced-thickness portions of the penetrator casing.

15. The munition of claim 14, wherein the lethality-enhancement material includes solid fragments that are projected by the warhead when the explosive is detonated.

16. The munition of claim 14, wherein the lethality-enhancement material includes an energetic material that releases energy when the explosive is detonated.

17. The munition of claim 1, wherein the fuzewell is made of steel.

18. The munition of claim 1, wherein the fuzewell is made of a single piece of material.

19. The munition of claim 1, where each of the spokes has sloped surfaces in both axial directions parallel to a longitudinal axis of the munition, sloping from a relatively narrow connection at the ring to a broader connection at the central housing.

* * * * *